United States Patent [19]

O'Donnell et al.

[11] Patent Number: 4,718,666

[45] Date of Patent: Jan. 12, 1988

[54] UPPER BODY EXERCISE DEVICE

[76] Inventors: Jerry L. O'Donnell, 3906 Onawa; Cecil W. Bopp, 2324 Ansborough Ave., both of Waterloo, Iowa 50701

[21] Appl. No.: 847,760

[22] Filed: Apr. 3, 1986

[51] Int. Cl.[4] ..... A63B 21/02

[52] U.S. Cl. ..... 272/137; 272/67

[58] Field of Search ..... 272/67, 68, 135, 137, 272/140, 142

[56] References Cited

U.S. PATENT DOCUMENTS

| | | | |
|---|---|---|---|
| 134,527 | 1/1873 | Eastman | 272/142 |
| 1,638,003 | 8/1927 | Neumann | 272/67 |
| 1,638,196 | 8/1927 | Guth | 272/68 |
| 1,680,901 | 8/1928 | Meyer | 272/137 |
| 1,729,399 | 9/1929 | Noe | 272/137 |
| 2,714,009 | 7/1955 | Urban | 272/137 |
| 3,069,161 | 12/1962 | Melchoina | 272/67 |
| 4,006,895 | 2/1977 | DeLaurenzio | 272/67 |
| 4,023,808 | 5/1977 | Hebert | 272/137 |
| 4,249,729 | 2/1981 | Gabrielidis | 272/137 X |
| 4,304,402 | 12/1981 | Ripp | 272/137 |
| 4,332,380 | 6/1982 | Cardin | 272/137 |
| 4,379,552 | 4/1983 | Webb et al. | 272/67 |
| 4,489,937 | 12/1984 | Kong | 272/137 |

FOREIGN PATENT DOCUMENTS

| | | | |
|---|---|---|---|
| 338019 | 6/1921 | Fed. Rep. of Germany . | |
| 245458 | 2/1926 | Italy | 272/68 |
| 2587 | of 1899 | United Kingdom | 272/135 |
| 433319 | 8/1935 | United Kingdom . | |

*Primary Examiner*—Richard J. Apley
*Assistant Examiner*—J. Welsh
*Attorney, Agent, or Firm*—Zarley McKee, Thomte, Voorhees & Sease

[57] ABSTRACT

An exercise device produced by a process, including oppositely disposed handle members having outer gripping portions and inner portions to which are attached flange members. An elastromeric middle member is molded at least over the flange members which connects the handle members into a unitary bar-like exercise device. The molding of the middle member encapsulates the flange members to provide a secure and non-releasable junction. The middle member, being deformable and twistable, allows many different types of exercise movements of the handle members. The middle member provides resistance to such deforming and twisting movements and also resiliently returns the handle members to an original position after deformation or twisting of the middle member.

15 Claims, 20 Drawing Figures

UPPER BODY EXERCISE DEVICE

BACKGROUND OF THE INVENTION

1. Field of the Invention

The present invention relates to an exercise device and its method or process of production, and in particular, to an exercise device produced by a special process used for development of the hands, wrists, arms, and upper body.

2. Problems in the Art

The benefits and value of exercising have in recent years become increasingly examined and acclaimed. Innumerable types and kinds of exercise equipment have been developed in response to the emphasis on exercise.

Many of these devices are complex, cumbersome, and expensive, many times so much so that it becomes prohibitive for individual exercisers to obtain such devices for personal use.

Therefore, much development has taken place in producing uncomplicated, economical, and manageable exercise devices and equipment for personal or at-home use. Exercising then can be accomplished simply and economically. This gives greater incentive to exercisers and hopefully promotes adherence to a continuing exercise program.

Uncomplicated and economical exercise devices for the upper body, and in particular the hands, wrists, arms, chest, and back, are very prevalent. Many of these devices utilize handles or hand gripping portions which the exerciser moves in response to some resistance to achieve exercise benefit. While many of these devices exist, there is still a real need for an exercise device for the development of the hands, wrists, arms, and upper body which combines the features of simplicity and economy, with durability and flexibility of use as an exercise device. For example, many such devices allow for resisted motion in one or two directions only. Others are beneficial only with respect to a limited part of the upper body, such as hands, biceps, or forearms.

It is therefore a primary object of the present invention to provide an exercise device for development of the hands, wrists, arms and upper body which improves upon or solves the problems in the art.

A further object of the present invention is to provide an exercise device which is uncomplicated in structure and use, yet allows great flexibility in the different types of exercises which can be performed with it.

A further object of the invention is to provide an exercise device which is produced by a special method to allow for flexibility of use and durability.

Another object of the invention is to provide an exercise device which is durable in structure and in repeated and long-term use.

Another object of the invention is to provide an exercise device which can be used by persons of all different types and levels of fitness.

These and other features, objects, and advantages of the invention will become more apparent with reference to the accompanying specification and claims.

SUMMARY OF THE INVENTION

The present invention is an exercise device, including the process by which it is made. The device of the invention is produced by positioning and securing flange means to inner ends of oppositely disposed handle members. An elastromeric middle member is then molded over the flanges, connecting the two handle members, and presenting a deformable and twistable part of the unitary device to allow the user to move the handle members for exercise purposes. The elastromeric middle member allows the handle members to be moved towards and away from one another, and to be twisted with respect to the middle member. The middle member provides resistance to such movement and at the same time resiliently returns the handle members to an original position after deformation or twisting, once force to the handle members is relaxed or released.

The molding of the elastromeric middle member over the flange members encapsulates the flange members to provide a secure and non-releasable junction between the middle member and the handle members.

The present invention therefore provides an uncomplicated structure which can be marketed at an economical price for purchasers, and which allows a plurality of different exercise movements for the benefit of the user.

The handle members can include handle grips and can be shaped in many different manners. The device can be beneficially used to develop at least the hands, wrists, arms, and the upper body, including the chest and back.

Figure 1:
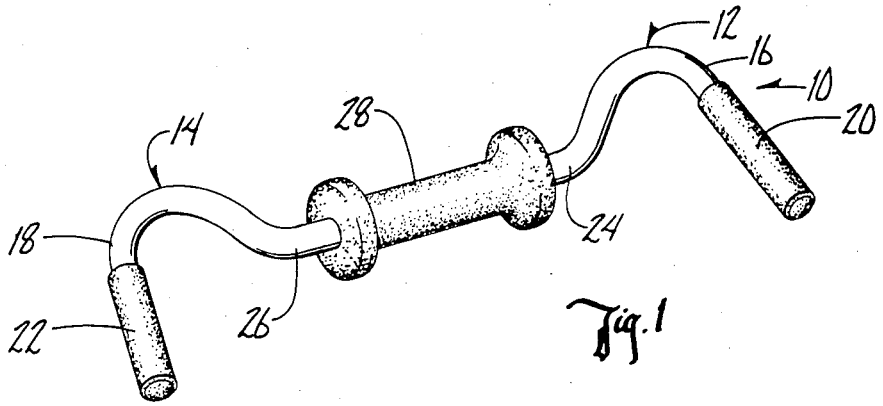
FIG. 1 is a perspective view of a preferred embodiment of the invention.

FIGS. *6a–f* depict a non-inclusive sampling of the various exercise movements which can be accomplished with the device of FIG. 1.

FIGS. *7a–g* depict a non-inclusive sampling of the different handle shapes which can be used with the invention.

FIGS. *8a* and *8b* depict alternative thicknesses of the middle member for the invention.

DETAILED DESCRIPTION OF THE PREFERRED EMBODIMENT

Figure 2:
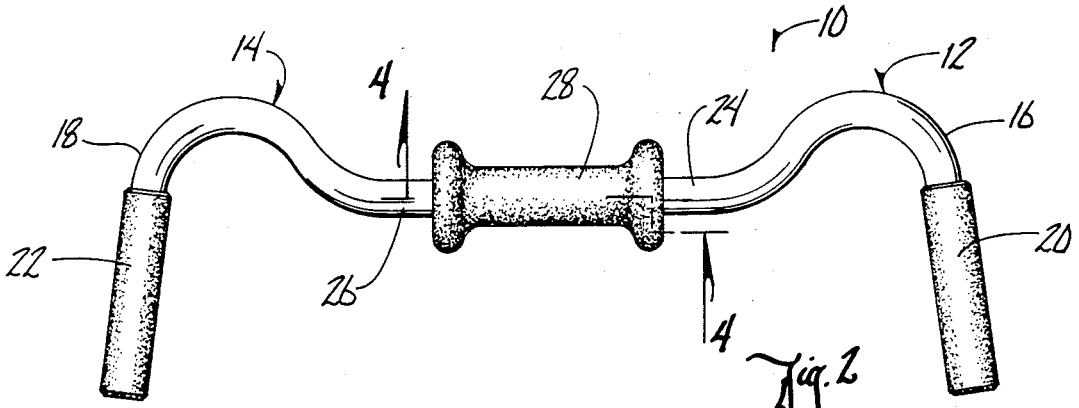
FIG. 2 is a top plan view of the device of FIG. 1.
Figure 3:
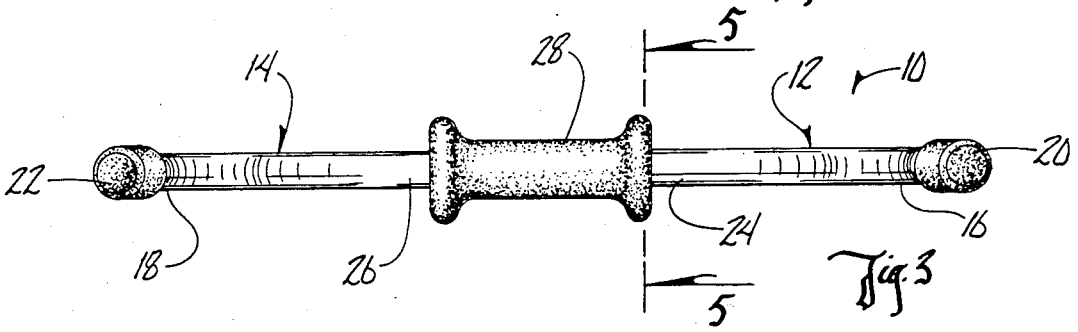
FIG. 3 is a side elevational view of the device of FIG. 1 also showing optional covers over the ends of the middle member.

With reference to the drawings, and in particular FIGS. 1–3, a preferred embodiment of the present invention can be seen. The exercise device 10 of the invention includes oppositely disposed handle members 12 and 14 having outer portions 16 and 18 which include handle grips 20 and 22. Inner portions 24 and 26 of handle members 12 and 14 terminate into a middle member 28 which is made of an elastromeric material which is deformable and twistable but is resilient.

Figure 4:
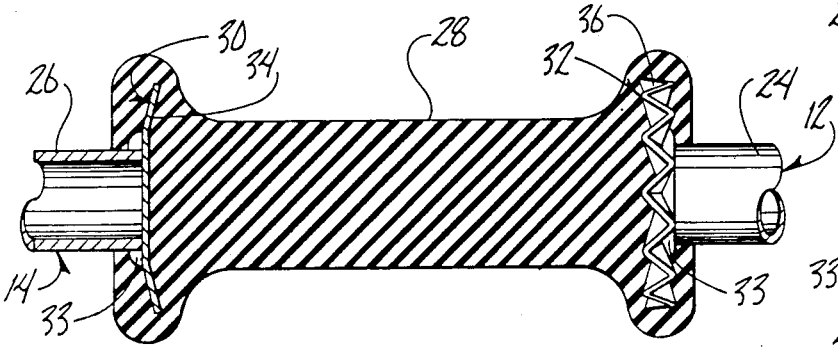
FIG. 4 is a cut-away and sectional view of the middle member of the invention showing two embodiments of the encapsulated flanges taken along lines 4—4 of FIG. 2.
Figure 5:
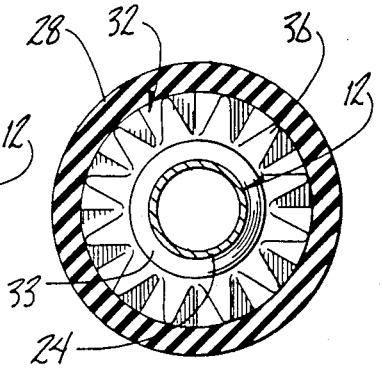
Figure 6A:
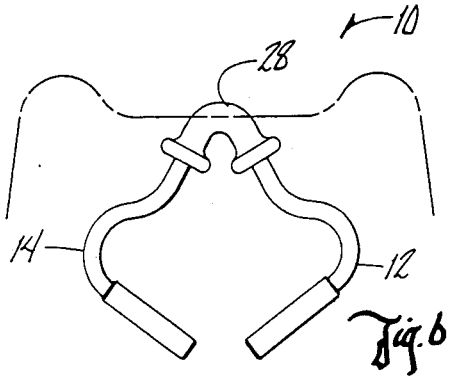
Figure 6B:
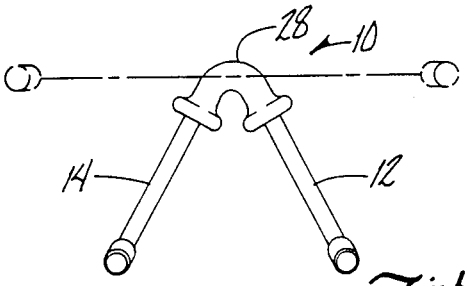
Figure 6C:
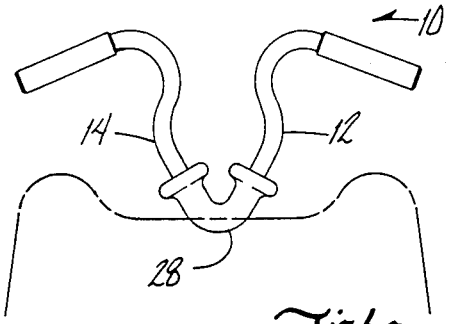
Figure 6D:
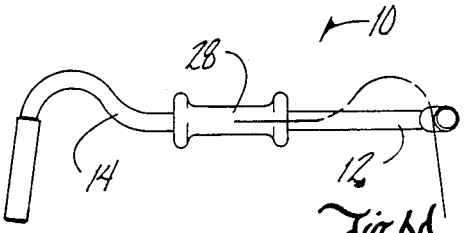
Figure 6E:
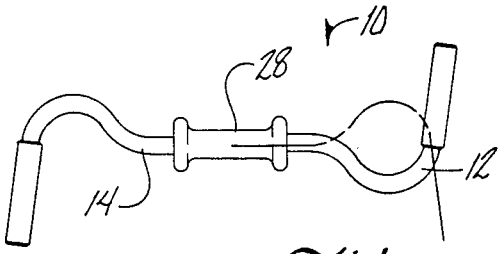
Figure 6F:
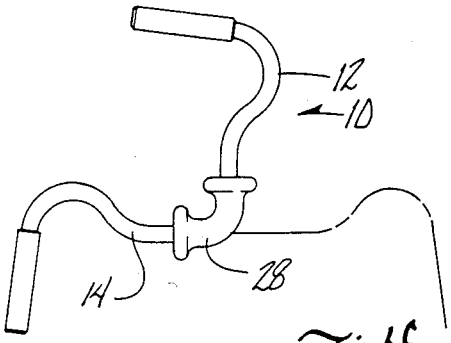
Figure 7A:
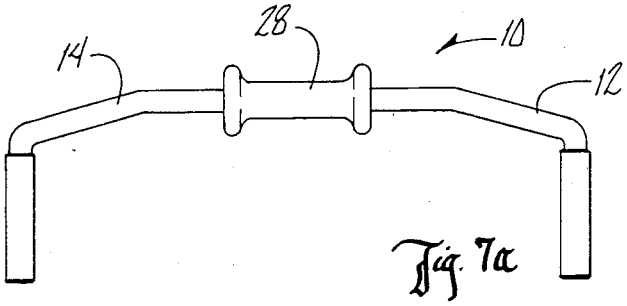
Figure 7B:
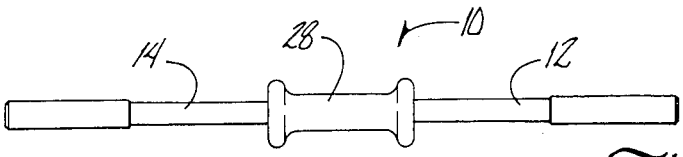
Figure 7C:
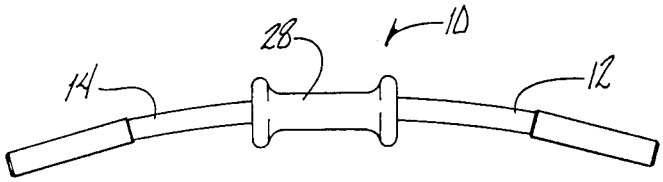
Figure 7D:
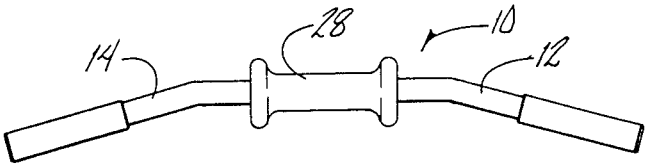
Figure 7E:
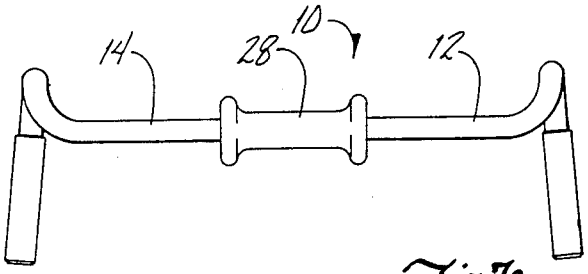
Figure 7F:
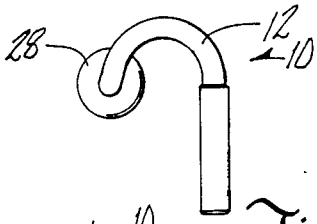
Figure 7G:
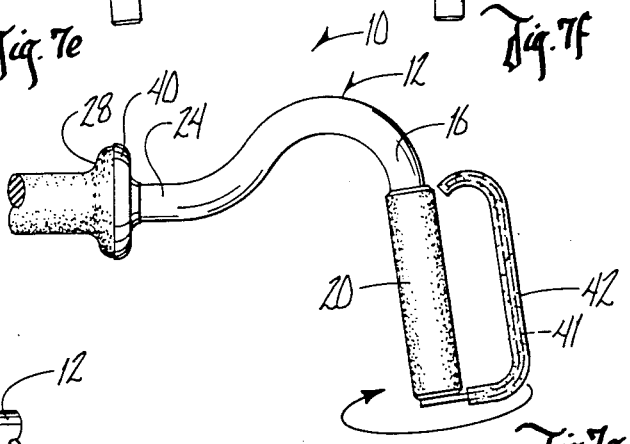

FIGS. 4 and 5 specifically depicts the exact manner by which exercise device 10 of FIG. 1 is produced. Flanges 30 and 32 are secured to their respective inner portions 24 and 26 of handle members 12 and 14. This can be accomplished by welds 33 or by other means known within the art. In FIG. 4 two alternative types of flanges are shown. It is to be understood that many flange shapes and configurations are possible while still staying within the boundaries of the invention. Generally, the same configuration of flange is used for flanges 30 and 32 in each device 10. Flanges 30 and 32, attached to handle members 12 and 14, are then positioned within a mold which casts middle member 28 around flanges 30 and 32, thereby encapsulating them, as can be more clearly seen in FIGS. 1-3. The molding process is conventional as is known in the art. Flanges 30 and 32, and to some extent inner portions 24 and 26, are thus encapsulated within the elastromeric material of middle member 28. Handle members 12 and 14 are also thus connected together to form the unitary exercise device 10. Handle grips 20 and 22 may or may not be added, as desired and may take many different forms. Additions such as covers 40 can optionally be added to protect the middle member 28 at the point it covers flanges 30 and 32 (see FIG. 7(*g*)).

It will be noted that it is preferred that the flanges have uneven or corrugated portions 36 around their perimeter such as is shown by flange 32 if FIGS. 4 and 5. These portions 36, in effect, give more surface area and a better surface for adhering and retention in middle member 28 than a flat surface. This is particularly important to resist slippage of handle members 12 and 14 when they are twisted with respect to middle member 28. Other forms and shapes of flanges can be utilized (see, for example, flange 30 with slightly bent edges 34 in FIG. 4), however, and exercise device 10 will still function according to its purpose. Protrusions or added on members could also be associated with flanges 30 and 32 to provide increased gripping when encapsulated by middle member 28.

The elastromeric material of middle member 28 in the preferred embodiment can be any one of a number of polyurethane elastomeres. Such polyurethane elastomeres are available from a variety of sources, including nationally known companies such as Uniroyal, Hexel, or United States Gypsum, and are known in the art. This material is used in the preferred embodiment because it is extremely durable, easily moldable, and has high resiliency and adhering properties. For example, these materials adhere to metal, which is particularly advantageous, as in the preferred embodiment, flanges 30 and 32 and handle members 12 and 14 are made of metal for strength and durability.

FIGS. 6(*a*)-(*f*) illustrate merely a sampling of the infinite number of various exercise movements which can be accomplished with device 10. In each Figure, the original undeformed position of device 10 is illustrated in ghost lines. FIGS. 6(*a*)-(*c*) illustrate how handle members 12 and 14 can be moved towards one another, thereby deforming middle portion 28. On the other hand, FIGS. 6(*d*) and (*e*) show how handle members 12 and 14 can be twisted with respect to middle member 28, thereby twisting middle member 28. FIG. 6(*f*) shows a combination of moving handle members 12 and 14 towards one another, while at the same time twisting them with respect to middle member 28.

The motions shown in FIGS. 6(*a*)-(*f*) are examples only, and innumerable other movements can be accomplished with device 10. Furthermore, conventionally, the user would grip handle grips 20 and 22 and perform the exercising movements with device 10 in front of the user. However, the user's hands can be crossed to opposite handle grips 20 or 22, or the device 10 can be grasped behind the user's head. Numerous other and varying uses can be performed.

FIGS. 7(*a*)-(*e*) depict alternative embodiments for the shape of handle members 12 and 14. FIG. 7(*f*) is a side view of the handle shape of FIG. 7(*e*). Again, this is only a mere sampling of the handle shape designs and any innumerable number of shapes are possible.

FIG. 7(*g*) shows the handle configuration for the device 10 as shown in FIGS. 1-6. A hand retainer member 41 can be optionally mounted to the ends of portions 12 and 14 of the device 10 to assist in retaining the user's hands to the device 10. Retainer members 41 are rotatably secured to the ends of device 10 and can be rotated 360° thereto. Likewise, a padded covering 42 can be mounted on retainer members 41 to pad them against the user's hands. Retainer members 41 can be removeably installed or removed by means known within the art to allow quick and easy attachment or detachment, according to desire. Retainer members 41 are particularly advantageous for use with persons who have strength in their arms sufficient to use device 10, but do not have strength or functioning sufficiently in their hands to adequately grip handles 20 and 22 of the device 10. Examples of such persons are arthritis patients or stroke patients who can move their arms but not their fingers. By having retainer members 41 their fingers can be put through and they can build up their arms with the exercising possible with device 10.

Figure 8A:
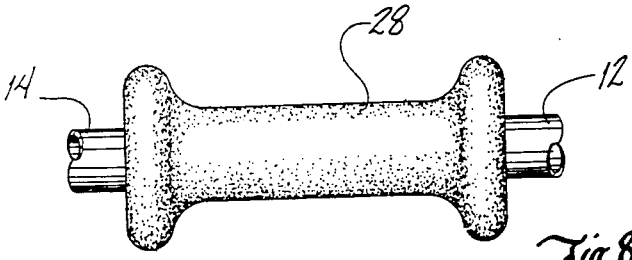
Figure 8B:
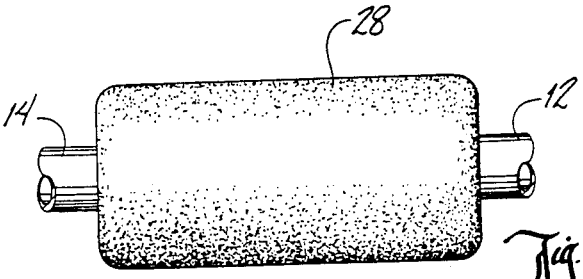

FIGS. 8(*a*) and (*b*) illustrate that the thickness or diameter of middle member 28 can be varied according to choice between relatively thin and less than the diameter of flange members 30 and 32, as shown in FIG. 8*a*, to a much thicker diameter (FIG. 8(*b*), where its diameter is about equal to the diameter of flanges 30 and 32. Generally, the thickness of middle member 28 will determine its resistance to movement. Therefore, each device 10 can be designed to have a specific resistance, and therefore a specific exercise benefit.

The included preferred embodiment above is given by way of example only, and not by way of limitation to the invention, which is solely described by the claims herein. Variations obvious to one skilled in the art will be included within the invention defined by the claims.

For example, middle member 28 could be made from other elastromeric materials having the same or similar properties. For example, natural or synthetic rubber could be used. It is to be understood that any number of types and kinds of elastomeres may be adaptable for use with the invention. As discussed above, handle shapes and thicknesses of middle member 28 can be varied according to desire.

What is claimed is:

1. An exercise device for development of the hands, wrists, arms, and upper body of an exerciser, comprising:

first and second oppositely disposed handle members having outer gripping portions and inner portions;

flange means secured to said inner portions of said handle members;

an elastromeric middle member, said middle member encapsulating each said flange means to provide a secure and non-releasable junction between said middle member and said handle members; and said middle member being deformable and twistable by a user from an original position allowing said handle members to be moved towards one another and to be twisted with respect to said middle member while providing resistance to such movement and resiliently returning to said original position after deformation and twisting of said middle member.

2. The device of claim 1 wherein said inner portions of said handle members extend outwardly and in opposite directions from said middle member when in said original position, said outer portions being angularly offset from said inner portions.

3. The device of claim 2 wherein said outer portions of said handle members are substantially perpendicular to said inner portions.

4. The device of claim 2 wherein said outer portions of said handle members are in substantially the same plane.

5. The device of claim 1 wherein said handle members are substantially linear.

6. The device of claim 1 further comprising handle grips secured to said outer gripping portions.

7. The device of claim 1 wherein said flange means are larger in diameter than said inner portions of said handle members.

8. The device of claim 7 wherein said flange means are substantially larger in diameter than said inner portions of said handle members.

9. The device of claim 7 wherein said flange means have uneven surfaces.

10. The device of claim 9 wherein said flange means include corrugated portions to increase retention in said middle member during twisting of said middle member.

11. The device of claim 7 wherein said middle member further comprises a center section between said flange means which is of smaller diameter than said flange means.

12. The device of claim 7 further comprising cover means positioned over and covering at least a portion of said middle member which encapsulates said flange means.

13. The device of claim 12 wherein said middle member adheres to said cover means.

14. The device of claim 1 wherein said middle member adheres to said flange means.

15. The device of claim 1 wherein retainer members are adjustably secured to the ends of the device for retaining the user's hands to the device during exercising.

* * * * *